US006886215B2

(12) United States Patent
Dodson et al.

(10) Patent No.: US 6,886,215 B2
(45) Date of Patent: May 3, 2005

(54) VACUUM CLEANER FILL TUBE WITH VALVE

(75) Inventors: Diane L. Dodson, Northfield, OH (US); Philip G. Hays, Westlake, OH (US); Robert L. Petrosky, Parma, OH (US); Phillip E. Bearden, Brunswick, OH (US)

(73) Assignee: The Scott Fetzer Company, Westlake, OH (US)

( * ) Notice: Subject to any disclaimer, the term of this patent is extended or adjusted under 35 U.S.C. 154(b) by 324 days.

(21) Appl. No.: 10/134,831

(22) Filed: Apr. 29, 2002

(65) Prior Publication Data

US 2003/0200620 A1 Oct. 30, 2003

(51) Int. Cl.[7] ..... A47L 9/14

(52) U.S. Cl. ..... 15/339; 15/347; 15/350; 15/351; 15/319; 55/376; 55/367

(58) Field of Search ..... 15/319, 339, 347, 15/350, 351; 55/374, 376, 377, 367, DIG. 2; 56/202, 320.2

(56) References Cited

U.S. PATENT DOCUMENTS

| | | | | |
|---|---|---|---|---|
| 1,163,716 A | * | 12/1915 | Van Der Putten | 55/367 |
| 2,114,105 A | | 4/1938 | Gerber | |
| 2,742,105 A | | 4/1956 | Dow | |
| 4,044,421 A | | 8/1977 | Kristenson et al. | 15/339 |
| 4,184,225 A | | 1/1980 | Leinfelt | 15/339 |
| 4,233,597 A | | 11/1980 | Kurz | 340/626 |
| 4,238,918 A | * | 12/1980 | Saruhashi et al. | 56/320.2 |
| 4,294,595 A | | 10/1981 | Bowerman | 15/339 |
| 4,631,909 A | * | 12/1986 | McLane | 56/202 |
| 4,678,486 A | | 7/1987 | Jacob et al. | 55/374 |
| 4,726,177 A | * | 2/1988 | McGoughy | 56/202 |
| 4,766,639 A | | 8/1988 | Lindquist et al. | 15/339 |
| 4,851,019 A | | 7/1989 | Ahlf et al. | 15/350 |
| 5,092,915 A | | 3/1992 | Lackner | 15/349 |
| RE34,980 E | | 6/1995 | Rau et al. | 15/339 |
| 5,472,465 A | | 12/1995 | Schmierer | 15/347 |
| 5,725,619 A | * | 3/1998 | Brule et al. | 55/367 |
| 5,907,886 A | | 6/1999 | Buscher | 15/319 |
| 5,907,889 A | | 6/1999 | Fukushima et al. | 15/339 |
| 5,940,931 A | | 8/1999 | Jeon | 15/339 |

* cited by examiner

*Primary Examiner*—Theresa T. Snider
(74) *Attorney, Agent, or Firm*—Jones Day

(57) ABSTRACT

An apparatus for use with a vacuum cleaner filter bag comprises a vacuum cleaner fill tube. The fill tube is configured for the bag to be mounted on the fill tube. The fill tube has an outlet through which a working flow of vacuum cleaner air can exit the fill tube to enter the bag when the bag is mounted on the fill tube. Additionally, the apparatus comprises a valve shiftable into and out of a closed condition in which the valve blocks the air from exiting the fill tube through the outlet.

55 Claims, 7 Drawing Sheets

VACUUM CLEANER FILL TUBE WITH VALVE

TECHNICAL FIELD

The present invention relates to vacuum cleaners.

BACKGROUND

A vacuum cleaner removes dirt from household surfaces. The dirt is entrained in a flow of air and transported through the vacuum cleaner. A vacuum cleaner fill tube directs the dirt laden air into a disposable filter bag that is mounted on the fill tube.

SUMMARY

The present invention is an apparatus for use with a vacuum cleaner filter bag. The apparatus comprises a vacuum cleaner fill tube configured for the bag to be mounted on the fill tube. The fill tube has an outlet through which a working flow of vacuum cleaner air can exit the fill tube to enter the bag when the bag is mounted on the fill tube. Additionally, the apparatus comprises a valve shiftable into and out of a closed condition in which the valve blocks the air from exiting the fill tube through the outlet.

In a preferred embodiment, the valve is shiftable from the closed condition to an open condition in response to mounting of the bag on the fill tube. The valve is operative in the open condition to permit the air to exit the fill tube through the outlet.

Preferably, the open condition of the valve is a fully open condition. The valve is configured to shift progressively toward and into the fully open condition under the influence of the bag as the bag moves progressively toward and into a fully mounted position. The valve reaches the fully open condition as the bag reaches the fully mounted position. An actuation structure of the valve is configured to shift the valve from the closed condition to the open condition under the influence of the bag. This is achieved by movement of a mounting collar on the bag against the actuation structure as the bag is mounted on the fill tube. The movement of the mounting collar against the actuation structure is through camming action by sliding contact between the collar and the actuation structure.

The valve is configured to be retained in the closed condition by a pressure differential across the valve. The pressure differential is produced by the air being blocked by the valve from exiting the fill tube. The valve is configured to be also shifted into the closed condition by the pressure differential if the valve is not already in the closed condition. A pressure sensor is operative to sense air pressure in the fill tube. An indicator is responsive to the sensor to emit a signal that is in response to and indicative of a rise in the air pressure produced by the air being blocked by the valve from exiting the fill tube, whereby the signal indicates that the valve is in the closed condition. The rise in the air pressure is defined by the air pressure exceeding a predetermined threshold level.

Also, preferably, the vacuum cleaner filter bag has a mounting collar. The collar has a collar opening with a notch. The fill tube has a tubular outlet structure centered on an axis. The fill tube is configured for the bag to be mounted on the fill tube by insertion of the outlet structure through the collar opening. Additionally, the fill tube is configured for a working flow of vacuum cleaner air to exit the fill tube through the outlet structure to enter the bag when the bag is mounted on the fill tube. The notch can slide over the actuation structure when the notch is circumferentially aligned with the actuation structure as the outlet structure is being inserted through the collar opening. The actuation structure retains the collar on the fill tube after the collar is rotated circumferentially about the outlet structure to move the notch out of circumferential alignment with the actuation structure.

DESCRIPTION

Figure 2:
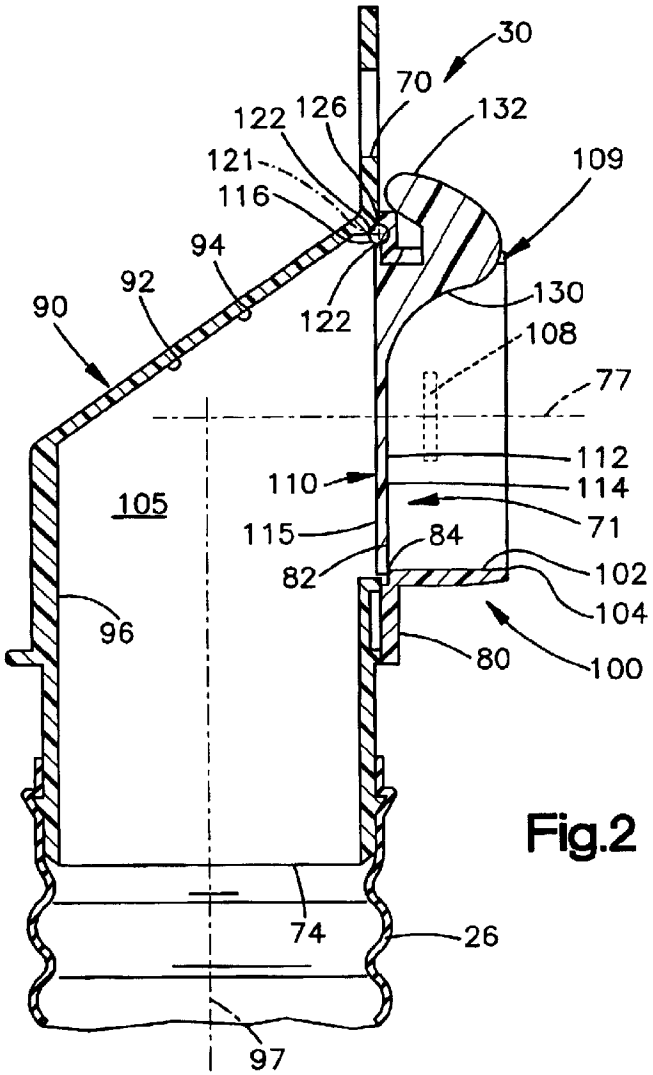
FIG. 2 is a sectional view of parts shown in FIG. 1.

The apparatus 10 shown in FIG. 1 has parts which, as described below, are examples of the elements recited in the claims.

The apparatus 10 is a vacuum cleaner. The vacuum cleaner 10 has a base 12 with wheels 16 and 18 and a handle 20. The base 12 includes an inlet nozzle 24 and an air line 26 connected to a fill tube 30. A disposable inner filter bag 32 is mounted on the fill tube 30. The inner filter bag 32 is encased in a permanent outer filter bag 36. In operation, a fan 40 within the base 12 generates a flow of air, indicated by the arrows 43. Debris, such as dirt from household surfaces, is entrained in the air. The debris is transported by the air through the nozzle 24 to the fan 40. The fan 40 drives the dirt laden air through the air line 26 and through the fill tube 30 into the inner bag 32. The air escapes through the inner bag 32 and the outer bag 36 to the atmosphere, and the debris is retained in the inner bag 32. The flow of air is a working flow in that it performs work by transporting debris by use of pressure and airflow.

Figure 3:
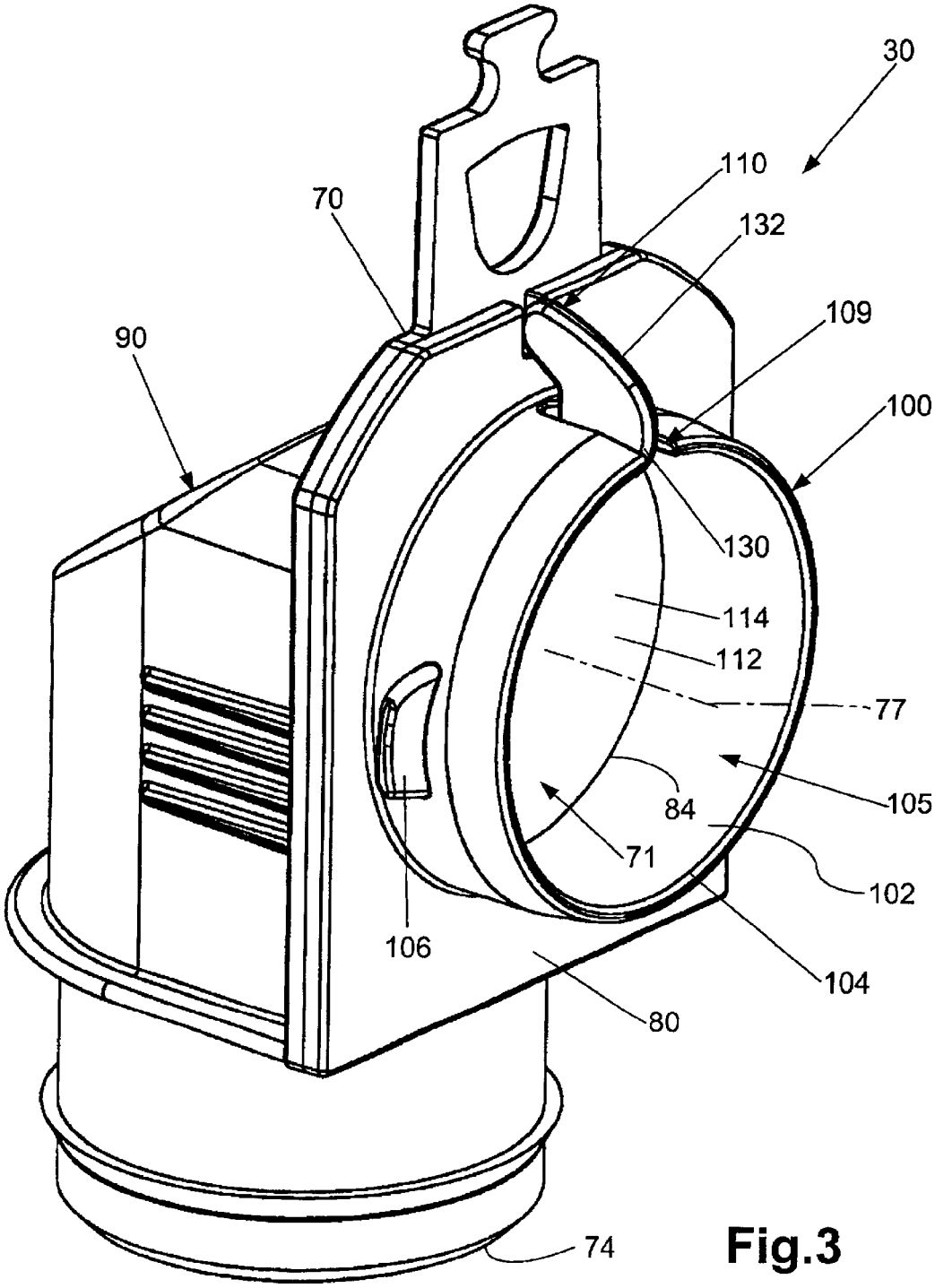
FIG. 3 is a perspective view of the parts shown in FIG. 2.

As shown in FIGS. 2 and 3, the fill tube 30 has a vertically extending abutment plate 70. The abutment plate 70 has a circular opening 71 centered on a horizontal axis 77. Referring to FIG. 2, the abutment plate 70 also has planar front and rear abutment surfaces 80 and 82. The rear abutment surface 82 has an annular edge 84 defining the opening 71.

The fill tube 30 further has a tubular inlet structure 90. The inlet structure 90 extends axially rearward and downward from the abutment plate 70 to an annular bottom edge 74. The inlet structure 90 has an inner wall surface 92 comprising two differently shaped portions adjoined together. One portion is a top wall surface 94 with an inclined planar configuration. The other portion is a side wall surface 96 with a cylindrical contour centered on a vertical axis 97.

As shown in FIG. 3, the fill tube 30 also has an outlet structure 100. In this embodiment, the outlet structure 100 is an outlet tube configured to be inserted into the inner bag 32 (FIG. 1) as the inner bag 32 is mounted on the fill tube 30. The outlet tube 100 is centered on the horizontal axis 77 and extends forward from the abutment plate 70. A cylindrical inner surface 102 extends axially forward from the rear edge 84 to an annular front edge 104. A pair of projections 106 and 108 (FIG. 2) extend radially outward from diametrically opposite sides of the outlet structure 100. Centered circumferentially between the projections 106 and 108 is an axially extending slit 109 in the outlet structure 100.

As shown in FIG. 2, a flow path 105 defined by the inner surfaces 82, 92 and 102 of the fill tube 30 extends fully through the fill tube 30 from the annular bottom edge 74 to the annular front edge 104. Following the flow path 105, the working flow of vacuum cleaner air exits the fill tube 30 through the outlet structure 100 to enter the bag 32 (FIG. 1) when the bag 32 is mounted on the fill tube 30.

Figure 4:
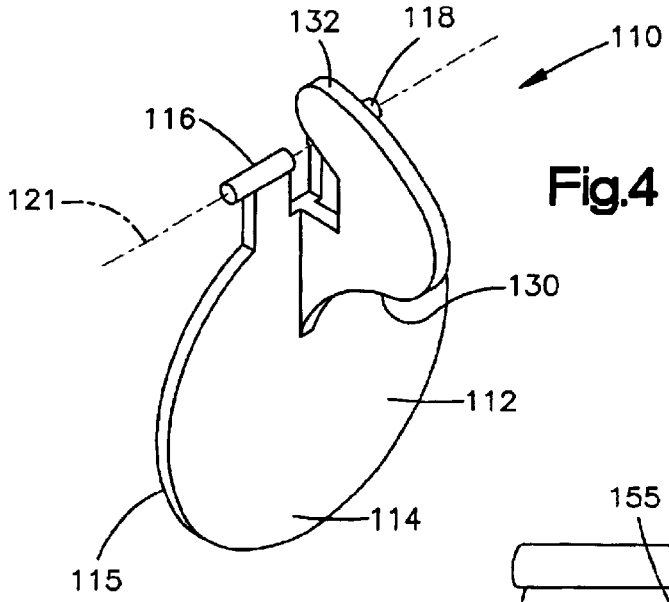
FIG. 4 is a perspective view a part shown in FIG. 3.

A valve 110 is located within the fill tube 30. As shown in FIG. 4, the valve 110 comprises a disk-shaped plate 112 having planar front and rear surfaces 114 and 115. Two rods 116 and 118 centered on an axis 121 are fixed with respect to the plate 112.

As shown in FIG. 2, the rods 116 and 118 are captured in an elongated socket 122 in the fill tube 30. The rods 116 and 118 and the socket 122 together form a hinge 126 about which the valve plate 112 can pivot. The valve plate 112 can thus pivot about the axis 121 between a closed position and an open position. In the closed position, shown in FIG. 2, the planar front surface 114 of the valve plate 112 abuts the planar rear abutment surface 82 of the fill tube 30. The valve plate 112 extends across the flow path 105, thus blocking the air from exiting the fill tube 30 through the outlet structure 100. The valve 110 is thus in a closed condition. In the open position (FIG. 10), the valve plate 112 extends along the top surface 94 of the fill tube 30 and not across the flow path 105. In this position, the planar rear surface 115 of the valve plate 112 extends along and faces the planar top surface 94 of the fill tube 30. The valve plate 112 thus permits the air to exit the fill tube 30 through the outlet structure 100. The valve 110 is thus in an open condition.

The valve 110 is shiftable from the closed condition to the open condition. This is achieved by use of an actuation structure 130, which, in this embodiment, is an actuator arm. The actuator arm 130 extends axially forward and upward from the valve plate 112. The arm 130 also extends radially outward through the slit 109 in the outlet tube 100. The arm 130 has a hook section 132 at its distal end.

In FIG. 2, the valve 110 is in an initial condition, hanging downward under the force of gravity. The valve 110 is oriented such that the air flow will shift it into the closed condition if it is not already in the closed condition. This is described more fully below.

Figure 5:
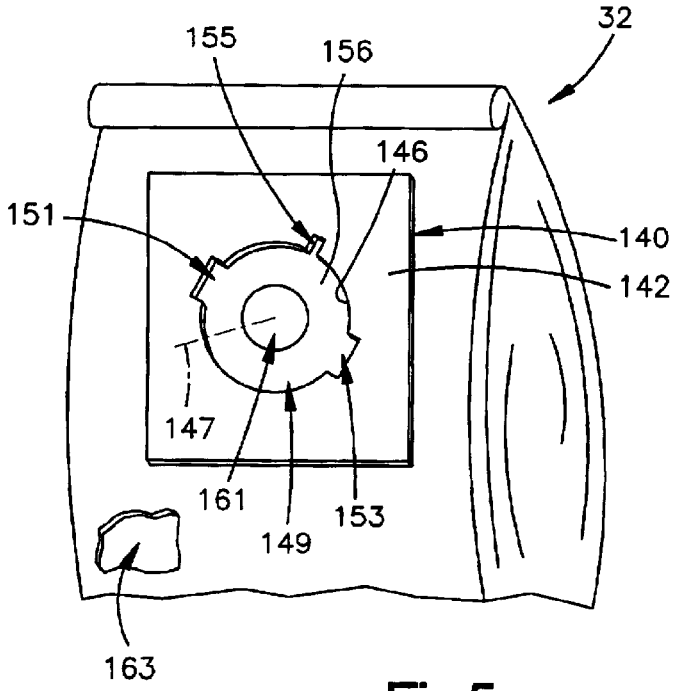
FIG. 5 if a perspective view of a part shown in FIG. 1.
Figure 6:
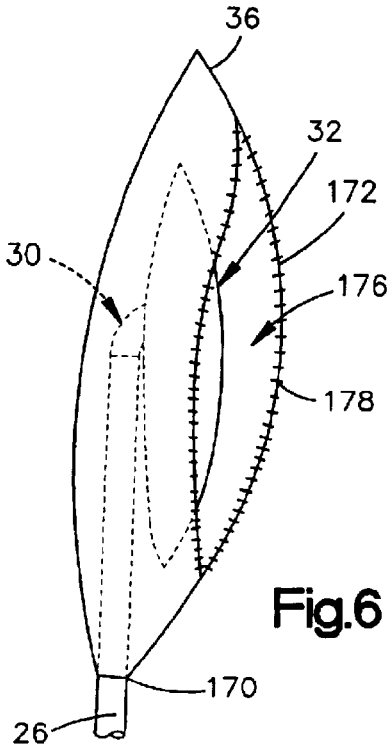
FIG. 6 is a schematic view of parts shown in FIG. 1.

The disposable inner filter bag 32 is shown in FIG. 5. The filter bag 32 is formed of layers of paper and melt blown polypropylene. Extending across an opening (not shown) in the bag 32 is a mounting collar 140 for mounting the bag 32 on the fill tube 30 (FIG. 3). The collar 140 has a rigid panel 142 adhered to the bag 32. An inner edge 146 of the panel 142 is centered on an axis 147 and defines an opening 149. The inner edge 146 has a circular shape that is interrupted by two rectangular notches 151 and 153 located diametrically opposite each other. The circular shape is also interrupted by a radially extending notch 155 centered circumferentially between the rectangular notches 151 and 153. An elastomeric diaphragm 156 is adhered to the panel 142 and extends across the panel opening 149. An opening 161 in the diaphragm 156 is centered on the axis 147 of the panel opening 149, thereby providing access to the bag interior 163. The permanent outer filter bag 36 is shown in FIG. 6. The outer bag 36 is formed of layers of cloth and melt blown polypropylene. An annular first edge 170 of the outer bag 36 is sealingly secured about the air line 26. A second edge 172 of the outer bag 36 defines a slit shaped access opening 176 through which the inner bag 32 can be inserted into the outer bag 36. The second edge 172 is fitted with a zipper 178 for closing the access opening 176. In normal use, the outer bag 36 does not accumulate debris in an amount sufficient to require cleaning of the outer bag 36. This is because the bulk of the dirt exiting the fill tube 30 is retained by the inner bag 32.

Figure 7:
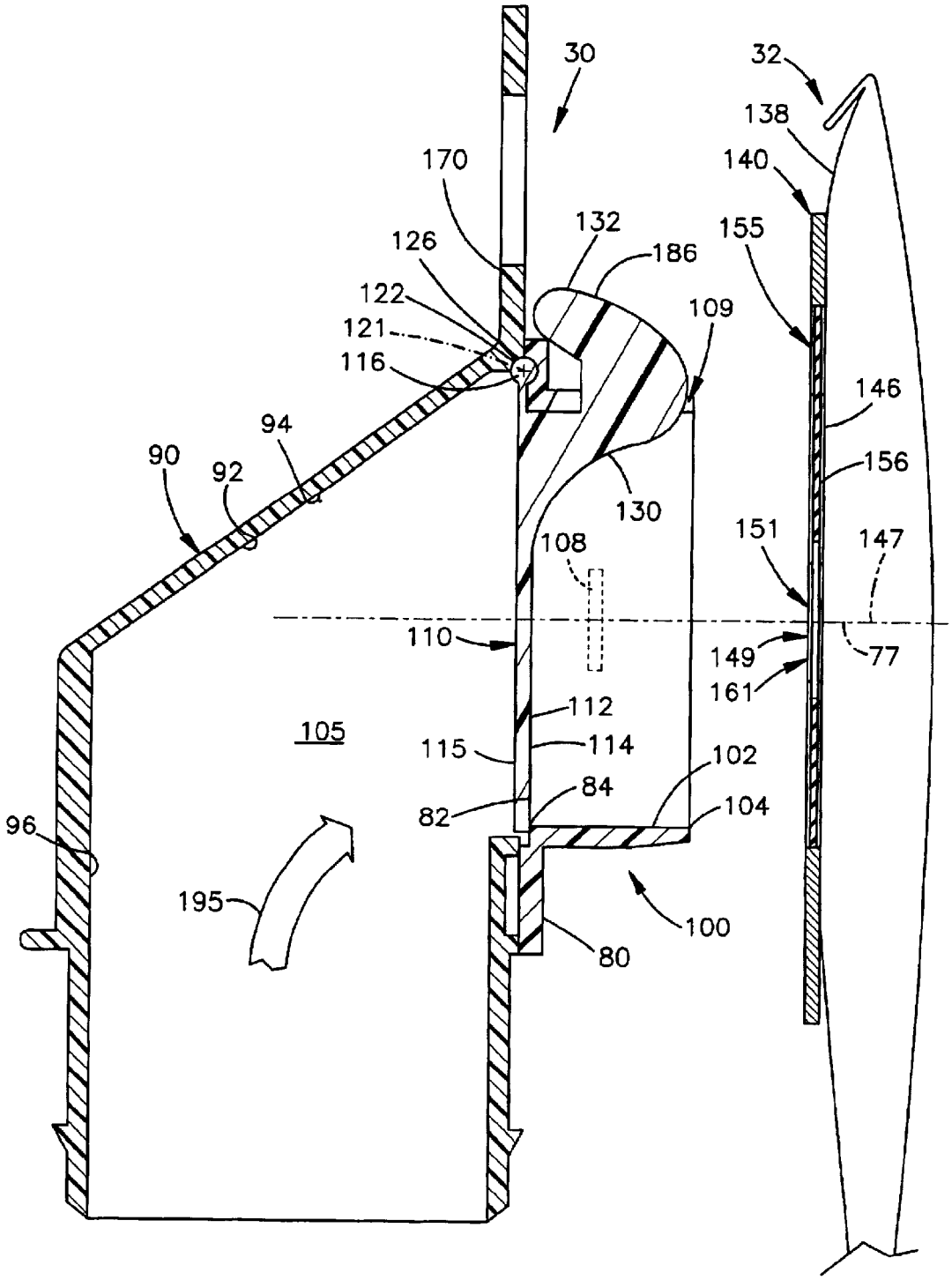
FIG. 7 is a sectional view of the parts of FIGS. 2 and 5, shown in a first relationship.

The inner bag 32 is preferably mounted on the fill tube 30 as follows. As shown in FIG. 7, the collar 140 is first located axially forward of the fill tube 30. The axis 147 of the collar 140 coincides with the axis 77 of the outlet structure 100. The collar 140 is oriented such that the rectangular notches 151 and 153 are circumferentially aligned with the tube projections 106 and 108. In this orientation, the radially extending notch 155 is circumferentially aligned with the actuator arm 130.

Figure 8:
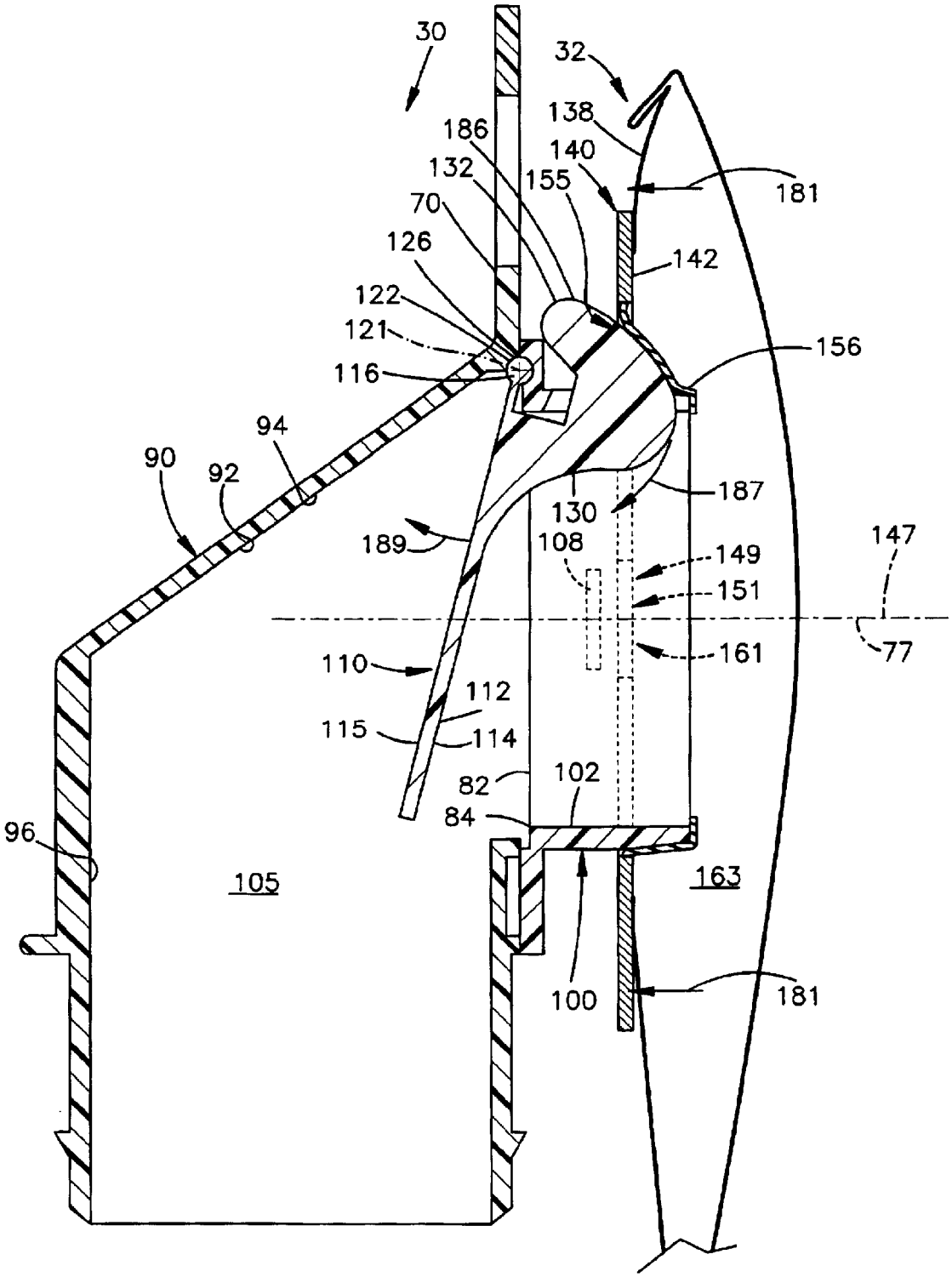
FIG. 8 is a sectional view of the parts of FIG. 7, shown in a second relationship.

Next, as indicated by the arrows 181 in FIG. 8, the collar panel 142 is moved axially forward to receive the fill tube 30. The fill tube 30 is inserted through the collar opening 149 into the bag 32. The notch 155 slides over the actuator arm 130. In this process, the diaphragm 156 moves against the top edge 186 of the actuator arm 130. In doing so, the diaphragm 156 pushes the hook 132 downward and inward in a camming action, as indicated by the arrow 187. The camming action is achieved through sliding contact between the actuator arm 130 and the diaphragm 156 of collar 140. This causes the valve plate 112 to pivot rearward and upward, as indicated by the arrow 189. During this process, the valve 110 shifts progressively toward and into a fully open condition under the influence of the bag 32 as the bag 32 moves progressively toward and into a fully mounted position.

Figure 9:
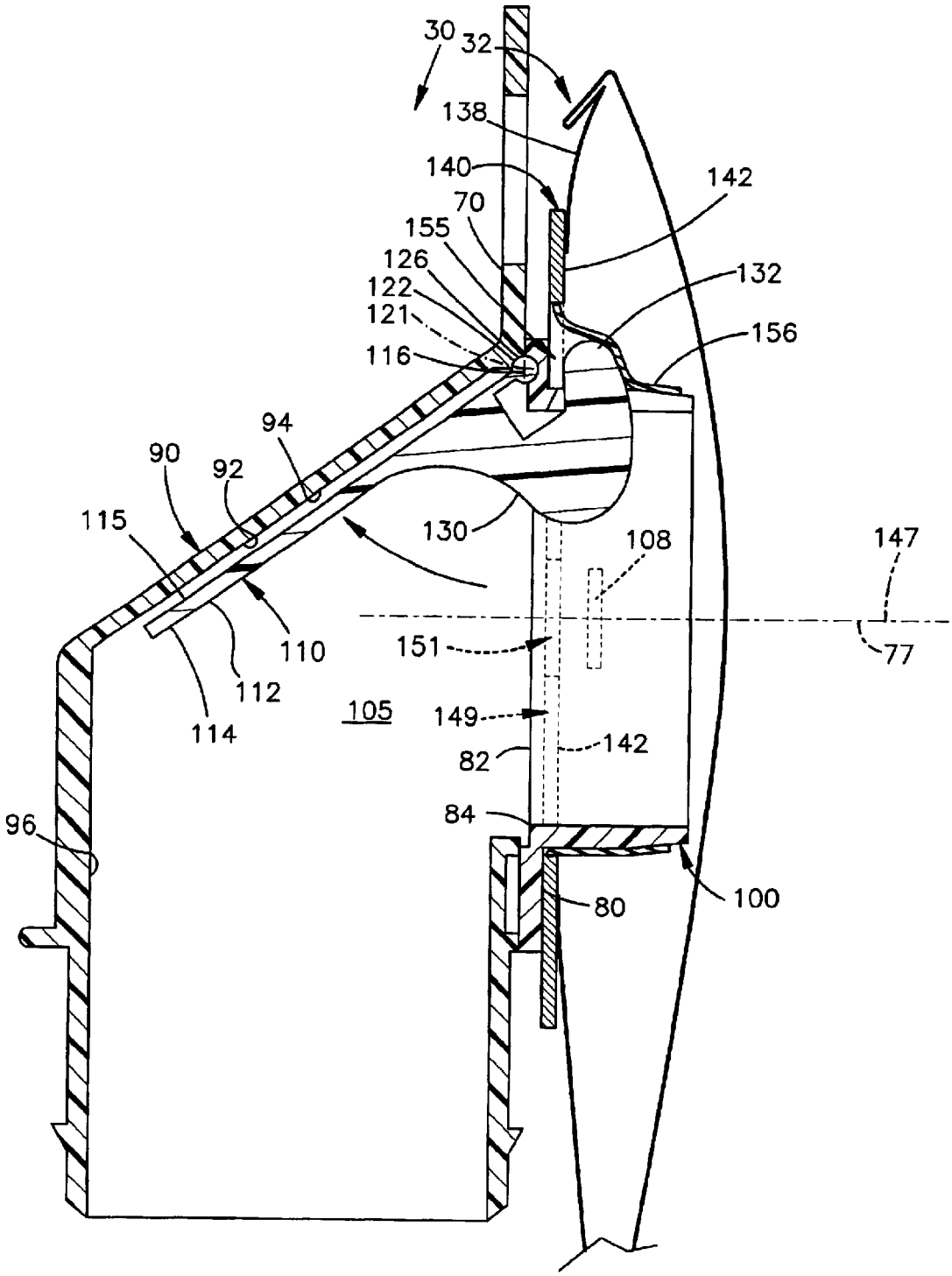
FIG. 9 is a sectional view of the parts of FIG. 7, shown in a third relationship.

As shown in FIG. 9, the collar 140 moves into abutment with the front abutment surface 80 as the valve plate 112 reaches the fully open position. This position extends along the top wall surface 94 and not across the flow path 105. The valve 110 thus reaches a fully open condition as the bag 32 reaches a fully mounted position. The hook 132, which was previously in front of the panel 142, is now behind the panel 142.

Figure 10:
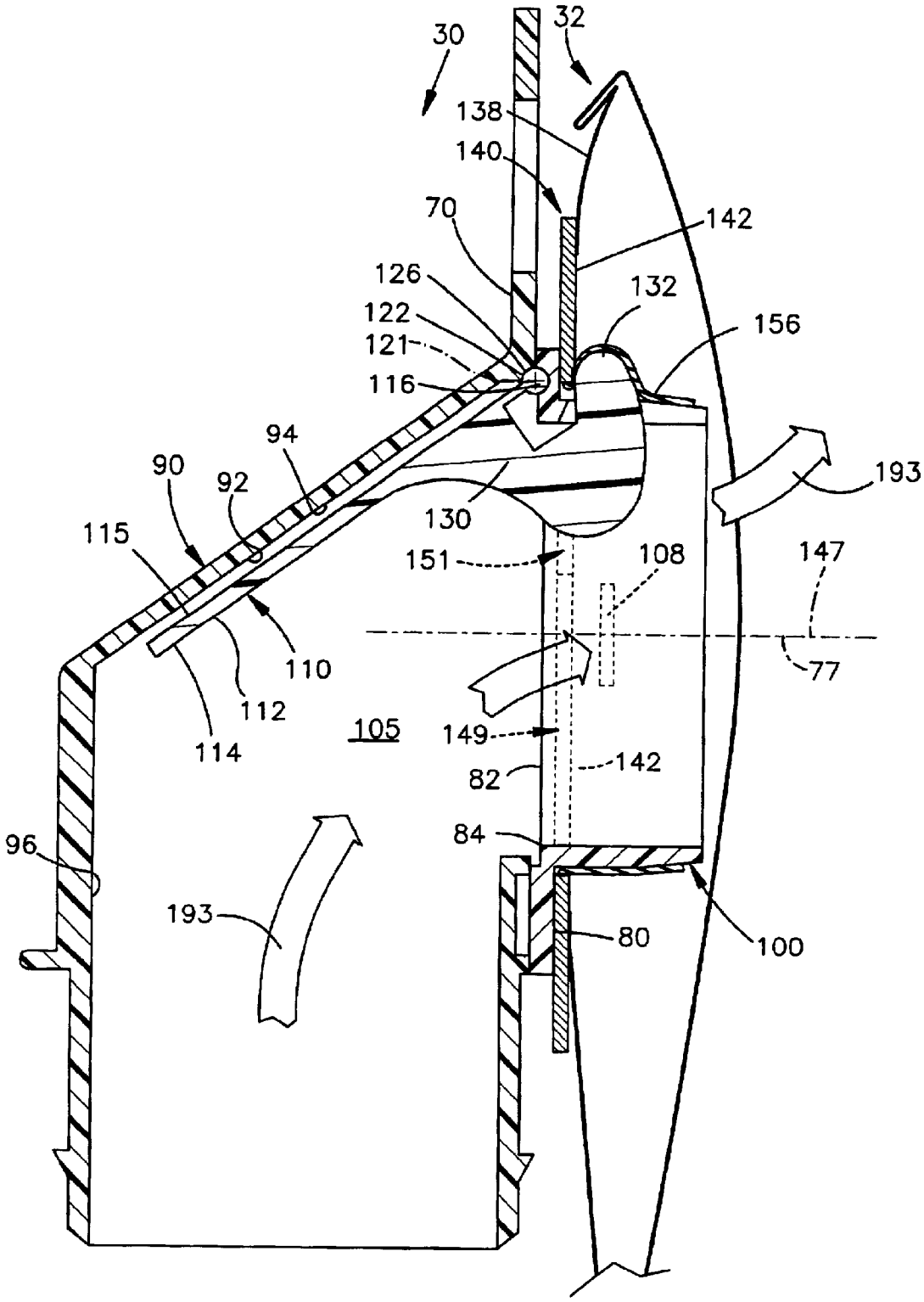
FIG. 10 is a sectional view of the parts of FIG. 7, shown in a fourth relationship.

Next, the collar 140 is locked in place. This is done by rotating the collar 140 circumferentially about the outlet structure 100. This moves the projections 106 and 108 circumferentially out of alignment with the rectangular notches 151 and 153. Concurrently, the actuator arm 130 is moved circumferentially out of alignment with the radially extending notch 155. As shown in FIG. 10, the panel 142 is then captured between the front abutment surface 80 and the projections 106 and 108. The panel 142 is also captured between the front abutment surface 80 and the hook section 132 of the arm 130. The arm 130 thus retains the collar 140 on the fill tube 30.

In normal operation, when the vacuum cleaner 10 is turned on, the valve 110 is in the open condition shown in FIG. 10. The working flow of air passes through the fill tube 30 into the inner bag 32, as indicated by the arrows 193. The air escapes through the inner bag 32 and the outer bag 36 (FIG. 1) to the atmosphere. The dirt is retained in the inner bag 32.

While the valve 110 is in the open condition, a portion of the air flow extends into the gap between the top wall surface 94 and the valve plate 112. This portion of the air flow presses against the rear surface 115 of the valve plate 112, urging it toward the closed position. However, the valve plate 112 is retained in the open position by abutment of the panel 142 against the hook 132.

Figure 1:
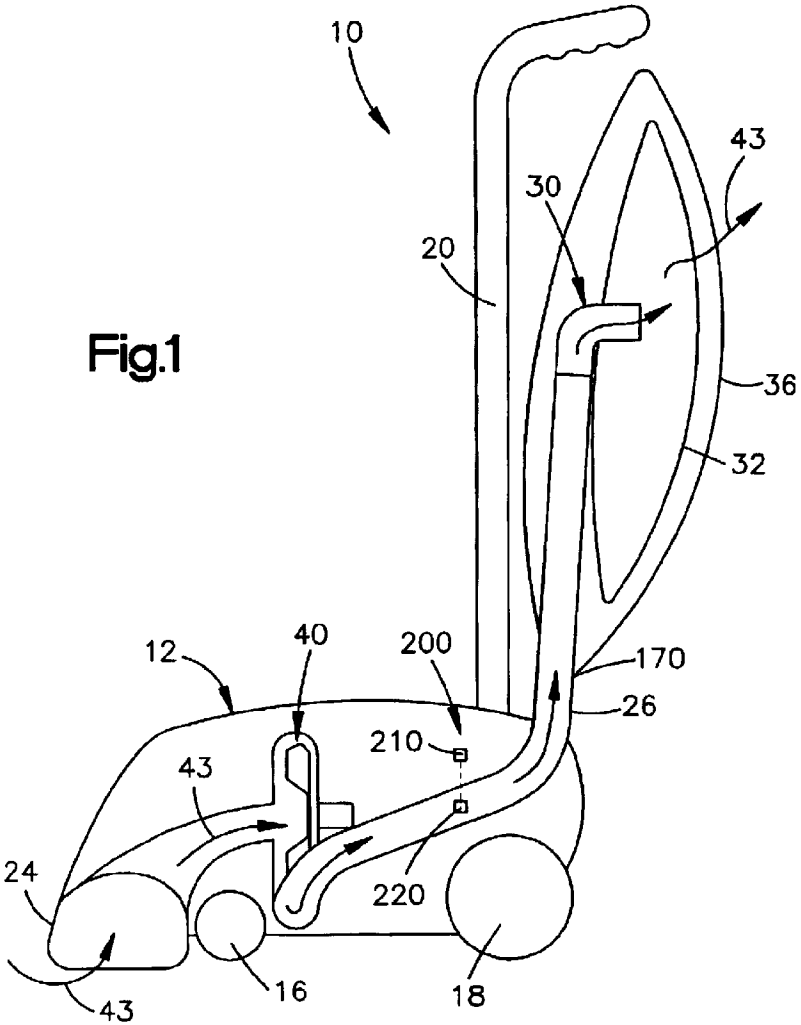
FIG. 1 is a schematic view of a vacuum cleaner.

As shown in FIG. 1, the fill tube 30 and the inner bag 32 are encased in the outer bag 36. They are therefore not visible to the user during operation of the vacuum cleaner 10. Consequently, if the bag 32 is not mounted on the fill tube 30, a user might accidentally turn on the vacuum cleaner 10, unaware that the bag 32 is not mounted in place. Alternatively, the user might incompletely mount the bag 32 on the fill tube 30 by inadvertently failing to lock it in place. The bag 32 might then be blown off the fill tube 30 when the vacuum cleaner 10 is turned on. As explained above, in such cases, the valve 110 will be in its closed condition, as shown in FIG. 7. The valve 110 will thus block the dirt laden air, indicated by the arrow 195, from exiting the fill tube 30.

The vacuum cleaner 10 also has a warning device 200, shown schematically in FIG. 1. The warning device 200 functions in conjunction with the valve 110 to notify the user that the bag 32 is not mounted on the fill tube 30. The operation of the warning device 200 is based on a rise in air pressure produced in the fill tube 30 by the air being blocked by the valve 110 (FIG. 2) from exiting the fill tube 30. This occurs when the valve 110 is in the closed condition due to the bag 32 not being mounted on the fill tube 30.

The warning device 200 includes an indicator 210 connected to and responsive to a pressure sensor 220. The sensor 220 is in fluid communication with the air in the fill tube 30 and senses the air pressure in the fill tube 30. The indicator 210 is responsive to the sensor 220 to emit a signal that is in response to and indicative of the rise in the air pressure produced by the air being blocked by the valve 110 from exiting the fill tube 30. In this embodiment, the rise in the air pressure is defined by the air pressure exceeding a predetermined threshold level. The signal can be an audible or visual signal to the user, such as by a warning light or a buzzer. The signal can also be an electrical signal to a device, for example, to a motor prompting the motor to turn off.

An example of the operation of the fill tube 30 in conjunction with the warning device 200 is as follows. In this example, the bag 32 is not mounted on the fill tube 30, as shown in FIG. 7, and the vacuum cleaner 10 is inadvertently turned on. The valve plate 112 initially hangs downward alongside the rear abutment surface 82 under the force of gravity. In this initial position, the valve plate 112 is oriented such that it blocks the outward flow of air sufficiently to produce an outwardly acting pressure differential across the valve 110. If the valve plate 112 is not already abutting the rear abutment surface 82, the pressure differential moves the valve plate 112 forward into abutment against the rear abutment surface 82, thereby shifting the valve 110 into the closed condition. Thus, when in its initial condition, the valve 110 either is already in the closed condition or will be shifted into the closed condition by the pressure differential. Additionally, the pressure differential presses the valve plate 112 against the rear abutment surface 82, thereby retaining the valve plate 112 in the closed position. Hence, the valve 110 is both shifted into and retained in the closed condition by the pressure differential. With the air blocked by the valve 110 from exiting the fill tube 30, the air pressure in the fill tube 30 rises above the threshold level. This is sensed by the sensor 220 (FIG. 1). In response, the indicator 210 emits the signal, which is indicative of the rise in the air pressure. This indicates that the valve 110 is in the closed condition. The user is therefore made aware that the bag 32 is not mounted on the fill tube 30.

In another example, the bag 32 is mounted on the fill tube 30 but not locked in place, as shown in FIG. 9. The valve 110 is in its open condition. When the vacuum cleaner is turned on, the bag 32 can be blown off the fill tube 30. If this occurs, a portion of the air flow presses against the rear surface 115 of the valve plate 112, urging it toward the closed position as described above. The valve 110 is thus shifted into the closed condition, preventing dirt laden air from exiting the fill tube. In the manner described above, the sensor 220 will sense the resulting rise in air pressure, and the indicator 210 will emit the signal.

In yet another example, the bag 32 is mounted on the fill tube 30 and locked in place, as shown in FIG. 10, and the vacuum cleaner 10 is turned on. In this situation, as explained above, the valve 110 is in the open condition. With the air free to exit the fill tube 30, the air pressure in the fill tube 30 is below the threshold level. Therefore, the indicator 210 (FIG. 1) does not emit the signal. The user consequently receives no indication that the bag 32 is not mounted on the fill tube 30.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for use with a vacuum cleaner filter bag, comprising:

a vacuum cleaner fill tube configured for the bag to be mounted on said fill tube, said fill tube having an outlet through which a working flow of vacuum cleaner air can exit said fill tube to enter the bag when the bag is mounted on said fill tube; and a valve shiftable into and out of a closed condition in which said valve blocks the air from exiting said fill tube through said outlet;

wherein said valve is configured to be retained in said closed condition by a pressure differential across said valve produced by the air being blocked by said valve from exiting said fill tube.

2. An apparatus as defined in claim 1 wherein said valve is configured to be shifted into said closed condition by said pressure differential if said valve is not already in said closed condition.

3. An apparatus as defined in claim 1 wherein said valve is configured to be oriented under the force of gravity to be in an initial condition from which said valve is shifted into said closed condition by said pressure differential if said valve is not already in said closed condition.

4. An apparatus for use with a vacuum cleaner filter bag, comprising:

a vacuum cleaner fill tube configured for the bag to be mounted on said fill tube, said fill tube having an outlet through which a working flow of vacuum cleaner air can exit said fill tube to enter the bag when the bag is mounted on said fill tube;

a valve shiftable into and out of a closed condition in which said valve blocks the air from exiting said fill tube through said outlet; and a pressure sensor operative to sense air pressure in said fill tube.

5. An apparatus as defined in claim 4 further comprising an indicator responsive to said sensor to emit a signal that is in response to and indicative of a rise in said air pressure produced by the air being blocked by said valve from exiting said fill tube, whereby said signal indicates that said valve is in said closed condition.

6. An apparatus as defined in claim 5 wherein said rise in said air pressure is defined by said air pressure acceding a predetermined threshold level.

7. An apparatus for use with a vacuum cleaner filter bag, comprising:

a vacuum cleaner fill tube configured for the bag to be mounted on said fill tube, said fill tube having an outlet through which a working flow of vacuum cleaner air can exit said fill tube to enter the bag when the bag is mounted on said fill tube; and a valve shiftable from a closed condition to an open condition in response to mounting of the bag on said fill tube, said valve being operative in said open condition to permit the air to exit said fill tube through said outlet, and being operative in said closed condition to block the air from exiting said fill tube through said outlet;

wherein said valve has an actuation structure configured to shift said valve from said closed condition to said open condition under the influence of the bag by movement of a mounting collar on the bag against said actuation structure as the bag is mounted on said fill tube.

8. An apparatus as defined in claim 7 wherein said movement of the mounting collar against said actuation structure is through camming action by sliding contact between the collar and said actuation structure.

9. An apparatus as defined in claim 7 wherein said actuation structure is configured to retain the bag on said fill tube when the bag is in a fully mounted position.

10. An apparatus for use with a vacuum cleaner filter bag, comprising:

a vacuum cleaner fill tube configured for the bag to be mounted on said fill tube, said fill tube having an outlet through which a working flow of vacuum cleaner air can exit said fill tube to enter the bag when the bag is mounted on said fill tube; and a valve shiftable torn a closed condition to an open condition in response to mounting of the bag on said fill tube, said valve being operative in said open condition to permit the air to exit said fill tube trough said outlet, and being operative in said closed condition to block the air from exiting said fill tube trough said outlet;

wherein said valve is configured to be retained in said closed condition by a pressure differential across said valve produced by the air being blocked by said valve from exiting said fill tube.

11. An apparatus as defined in claim 10 wherein said valve is configured to be shifted into said closed condition by said pressure differential if said valve is not already in said closed condition.

12. An apparatus as defined in claim 10 wherein said valve is configured to be oriented under the force of gravity to be in an initial condition from which said valve is shifted into said closed condition by said pressure differential if said valve is not already in said closed condition.

13. An apparatus for use with a vacuum cleaner filter bag, comprising:

a vacuum cleaner fill tube configured for the bag to be mounted on said fill tube, said fill tube having an outlet through which a working flow of vacuum cleaner air can exit said fill tube to enter the bag when the bag is mounted on said fill tube; and a valve shiftable from a closed condition to an open condition in response to mounting of the bag on said fill tube, said valve being operative in said open condition to permit the air to exit said fill tube through said outlet, and being operative in said closed condition to block the air from exiting said fill tube through said outlet;

wherein said valve is configured such that, when in said open condition, said valve is urged toward said closed condition by the flow of air.

14. An apparatus for use with a vacuum cleaner filter bag, comprising:

a vacuum cleaner fill tube configured for the bag to be mounted on said fill tube, said fill tube having an outlet through which a working flow of vacuum cleaner air can exit said fill tube to enter the bag when the bag is mounted on said fill tube; and a valve shiftable from a closed condition to an open condition in response to mounting of the bag on said fill tube, said valve being operative in said open condition to permit the air to exit said fill tube through said outlet, and being operative in said closed condition to block the air from exiting said fill tube through said outlet; and a pressure sensor operative to sense air pressure in said fill tube.

15. An apparatus as defined in claim 14 further comprising an indicator responsive to said sensor to emit a signal that is in response to and indicative of a rise in said air pressure produced by the air being blocked by said valve from exiting said fill tube, whereby said signal indicates that said valve is in said closed condition.

16. An apparatus as defined in claim 15 wherein said rise in said air pressure is defined by said air pressure exceeding a predetermined threshold level.

17. An apparatus comprising:

a vacuum cleaner filter bag having a mounting collar, said collar having a collar opening with a notch;

a vacuum cleaner fill tube having a tubular outlet structure centered on an axis said fill tube being configured for said bag to be mounted on said fill tube by insertion of said outlet structure through said collar opening, said fill tube also being configured for a working flow of vacuum cleaner air to exit said fill tube through said outlet structure to enter said bag when said bag is mounted on said fill tube; and a valve shiftable from a closed condition to an open condition in response to mounting of the bag on said fill tube, said valve being operative in said open condition to permit the air to exit said fill tube through said outlet structure, and being operative in said closed condition to block the air from exiting said fill tube through said outlet structure;

said valve having an actuation structure configured to shift said valve from said closed condition to said open condition by movement of said collar against said actuation structure; and said actuation structure being further configured to enable said notch to slide over said actuation structure when said notch is circumferentially aligned with said actuation structure as said outlet structure is being inserted through said collar opening, and said actuation structure being thither configured to retain said collar on said fill tube after said collar is rotated circumferentially about said outlet structure to move said notch our of circumferential alignment with said actuation structure.

18. An apparatus as defined in claim 17 wherein said valve is configured to be retained in said closed condition by a pressure differential across said valve produced by the air being blocked by said valve from exiting said fill tube.

19. An apparatus as defined in claim 17 further comprising a pressure sensor operative to sense a rise in air pressure produced in said fill tube by the air being blocked by said valve from exiting said fill tube.

20. An apparatus comprising:

a fill tube configured for a filter bag to be mounted on said fill tube, said fill tube having an outlet through which a working air flow can exit said fill tube to enter the bag when the bag is mounted on said fill tube; and a valve plate having a closed position in which said plate blocks the air from exiting said outlet, and being pivotable from said closed position, in a direction opposite the direction of the air flow, into an open position in which the air can exit said outlet.

21. The apparatus of claim 20 wherein the fill tube is a vacuum cleaner fill tube.

22. The apparatus of claim 20 wherein said plate is configured to be oriented under the force of gravity to be in an initial position from which said plate is shifted into said closed position by a pressure differential produced by the air in the fill tube.

23. The apparatus of claim 20 further comprising a pressure sensor operative to sense air pressure in said fill tube.

24. The apparatus of claim 23 further comprising an indicator responsive to said sensor to emit a signal that is in response to and indicative of a rise in said air pressure produced by the air being blocked by said plate.

25. The apparatus of claim 20 wherein the pivoting of said plate occurs progressively under the influence of the bag as the bag moves progressively toward a fully mounted position.

26. The apparatus of claim 20 wherein said plate is pivotable into said open position in response to mounting of the bag on said fill tube.

27. An apparatus comprising:

a fill tube configured for a filter bag to be mounted on said fill tube, said fill tube having an outlet through which a working air flow can exit said fill tube to enter the bag when the bag is mounted on said fill tube; and a valve plate having a closed position in which said plate blocks the air from exiting said outlet by extending across said outlet, and being, from said closed position, pivorable into said fill tube into an open position in which the air can exit said outlet.

28. The apparatus of claim 27 wherein the fill tube is a vacuum cleaner fill tube.

29. The apparatus of claim 27 wherein said plate is configured to be oriented under the force of gravity to be in an initial position from which said plate is shifted into said closed position by a pressure differential produced by the air in the fill tube.

30. The apparatus of claim 27 further comprising a pressure sensor operative to sense air pressure in said fill tube.

31. The apparatus of claim 27 wherein said plate is pivotable into said open position in response to mounting of the bag on said fill tube.

32. An apparatus comprising:

a fill tube configured for a filter be to be mounted on said fill tube said fill tube having an outlet through which a working air flow can exit said fill tube to enter the bag when the bag is mounted on said fill tube; and a valve shiftable from a closed condition to an open condition in respose to mounting of the bag on said fill tube, said valve being operative in said open condition to permit the air to exit said fill tube through said outlet, and being operative in said closed condition to block the air from exiting said fill tube through said outlet;

wherein said valve is configured to be retained in said closed condition by a pressure differential across said valve produced by the air being blocked by said valve from exiting said fill tube.

33. The apparatus of claim 32 wherein said valve is configured to be shifted into said closed condition by said pressure differential if said valve is not already in said closed condition.

34. The apparatus of claim 32 wherein said valve is configured to be oriented under the force of gravity to be in an initial condition from which said valve is shifted into said closed condition by said pressure differential if said valve is not already in said closed condition.

35. An apparatus comprising:

a fill tube configured for a filter bag to be mounted on said fill tube, said fill tube having an outlet through which a working air flow can exit said fill tube to enter the bag when the bag is mounted on said fill tube; and a valve shiftable from a closed condition to an open condition in response to mounting of the bag on said fill tube, said valve being operative in said open condition to permit the air to exit said fill tube through said outlet, and being operative in said closed condition to block the air from exiting said fill tube through said outlet;

wherein said valve is configured such that, when in said open condition, said valve is urged toward said closed condition by the air flow.

36. An apparatus comprising:

a fill tube configured for a filter bag to be mounted on said fill tube, said fill tube having an outlet through which a working air flow can exit said fill tube to enter the bag when the bag is mounted on said fill tube;

a valve shiftable from a closed condition to an oven condition in response to mounting of the bag on said fill tube, said valve being operative in said oven condition to permit the air to exit said fill tube through said outlet, and being operative in said closed condition to block the air from exiting said fill tube through said outlet; and a pressure sensor operative to sense air pressure in said fill tube.

37. The apparatus of claim 36 further comprising an indicator responsive to said sensor to emit a signal that is in response to and indicative of a rise in said air pressure produced by the air being blocked by said valve from exiting said fill tube, whereby said signal indicates that said valve is in said closed condition.

38. The apparatus of claim 37 wherein said rise in said air pressure is defined by said air pressure exceeding a predetermined threshold level.

39. An apparatus comprising:

a fill tube configured for a filter bag to be mounted on said fill tube, said fill tube having an outlet through which a working air flow can exit said fill tube to enter the bag when the bag is mounted on said fill tube; and a valve shiftable into and out of a closed condition in which said valve blocks the air from exiting said fill tube through said outlet;

said valve being configured to be retained in said closed condition by a pressure differential across said valve produced by the air being blocked by said valve from exiting said fill tube.

40. An apparatus as defined in claim 39 wherein said valve is configured to be shifted into said closed condition by said pressure differential if said valve is not already in said closed condition.

41. An apparatus as defined in claim 39 wherein said valve is configured to be oriented under the force of gravity to be in an initial condition from which said valve is shifted into said closed condition by said pressure differential if said valve is not already in said closed condition.

42. An apparatus comprising:

a fill tube configured for a filter bag to be mounted on said fill tube, said fill tube having an outlet through which a working air flow can exit said fill tube to enter the bag when the bag is mounted on said fill tube;

a valve shiftable into and out of a closed condition in which said valve blocks the air from exiting said fill tube through said outlet; and a pressure sensor operative to sense air pressure in said fill tube.

43. An apparatus as defined in claim 42 further comprising an indicator responsive to said sensor to emit a signal that is in response to and indicative of a rise in said air pressure produced by the air being blocked by said valve from exiting said fill tube, whereby said signal indicates that said valve is in said closed condition.

44. An apparatus as defined in claim 43 wherein said rise in said air pressure is defined by said air pressure exceeding a predetermined threshold level.

45. An apparatus comprising:

a fill tube configured for a filter bag to be mounted on said fill tube, said fill tube having an outlet through which air can exit said fill tube to enter the bag when the bag is mounted on said fill tube; and a valve shiftable from a closed condition in which said valve blocks the air from exiting said fill tube through said outlet to an open condition in which said valve permits the air to exit said fill tube through said outlet;

said valve having an actuation structure configured to shift said valve from said closed condition into said open condition by movement of a mounting collar or the bag against said actuation structure as the bag is mounted on said fill tube.

46. The apparatus of claim 45 wherein said movement of the mounting collar against said actuation structure is through camming action by sliding contact between the collar and said actuation structure.

47. The apparatus of claim 45 wherein said actuation structure is configured to retain the bag on said fill tube when the bag is in a fully mounted position.

48. The apparatus of claim 45 wherein said fill tube is configured to be inserted through an opening in the mounting collar when the bag is mounted on said fill tube.

49. The apparatus of claim 45 further comprising a filter bag having a mounting collar with a collar opening, configured to be mounted on said fill tube by insertion of the fill tube through said collar opening.

50. An apparatus comprising:

a fill tube configured for a filter bag to be mounted on said fill tube, said fill tube having an outlet through which air can exit said fill tube to enter the bag when the bag is mounted on said fill tube; and a valve shiftable from a closed condition in which said valve blocks the air from exiting said fill tube through said outlet to an open condition in which said valve permits the air to exit said fill tube through said outlet;

said valve having an actuator an configured to shift said valve from said closed condition into said open condition by movement of a fixture of the bag against said actuator an as the bag is mounted on said flit tube, and further configured to retain the bag on said fill tube when the bag is in a fully mounted position.

51. The apparatus of claim 50 wherein said fixture is a mounting collar.

52. An apparatus comprising:

a fill tube configured for a filter bag to be mounted on said fill tube, said fill tube having an outlet through which an air flow can exit said fill tube to enter the bag when the bag is mounted on said fill tube; and a valve shiftable from a closed condition in which said valve blocks the air from exiting said fill tube through said outlet into an open condition in which said valve permits the air to exit said fill tube through said outlet, and configured to be urged toward said closed condition by the air flow.

53. The apparatus of claim 52 wherein said valve is shiftable from said closed condition to said opening condition in response to mounting of the bag on said fill tube.

54. An apparatus comprising:

a fill tube configured for a filter bag to be mounted on said fill tube, said fill tube having an outlet through which air can exit said fill tube to enter the bag when the bag is mounted on said fill tube;

a valve shiftable from a closed condition in which said valve blocks the air from exiting said fill tube through said outlet to an open condition in which said valve permits the air to exit said fill tube through said outlet; and a pressure sensor operative to sense air pressure in said fill tube.

55. The apparatus of claim 54 further comprising an indicator responsive to said sensor to emit a signal that is in response to and indicative of a rise in said air pressure produced by the air being blocked by said valve from exiting said fill tube, whereby said signal indicates that said valve is in said closed condition.

* * * * *